United States Patent [19]

Totani

[11] Patent Number: 4,995,859

[45] Date of Patent: Feb. 26, 1991

[54] SHEET MATERIAL STACKING APPARATUS

[75] Inventor: Mikio Totani, Kyoto, Japan

[73] Assignee: Totani Giken Kogyo Co., Ltd., Kyoto, Japan

[21] Appl. No.: 443,078

[22] Filed: Nov. 27, 1989

Related U.S. Application Data

[63] Continuation of Ser. No. 185,553, Apr. 25, 1988, abandoned.

[30] Foreign Application Priority Data

Apr. 17, 1986 [JP] Japan ..... 61-89354

[51] Int. Cl.[5] ..... B65H 29/68; B65H 29/70

[52] U.S. Cl. ..... 493/204; 271/182; 271/188; 271/209; 318/370

[58] Field of Search ..... 493/227, 233–235, 493/341, 204

[56] References Cited

U.S. PATENT DOCUMENTS

| | | | |
|---|---|---|---|
| 1,530,989 | 3/1925 | Farmer et al. | 318/305 |
| 1,996,476 | 4/1935 | Krause | 318/305 |
| 3,643,143 | 2/1972 | Rakes | 318/305 |
| 3,890,886 | 6/1975 | Fessler et al. | 271/188 |
| 4,211,599 | 7/1980 | Bolter, et al. | 493/341 |
| 4,277,241 | 7/1981 | Schulze | 493/227 |
| 4,386,924 | 6/1983 | Crawford | 493/235 |
| 4,664,368 | 5/1987 | Bouwens et al. | 271/209 |
| 4,693,461 | 9/1987 | Takahashi | 271/176 |
| 4,696,463 | 9/1987 | Nakazato et al. | 271/176 |
| 4,744,555 | 5/1988 | Naramore et al. | 271/209 |
| 4,860,621 | 8/1989 | Totani | 493/341 |

FOREIGN PATENT DOCUMENTS 53697 5/1974 Japan .

*Primary Examiner*—H. Grant Skaggs
*Assistant Examiner*—Steve Reiss
*Attorney, Agent, or Firm*—Morgan & Finnegan

[57] ABSTRACT

According to the invention, a number of sheet materials P1 are successively delivered to and clamped between a plurality of clamp rollers 5. A servo motor 6 is operatively connected to the clamp rollers 5 to rotate the latter. A detector PH1 is disposed upstream of the clamp rollers 5 and detects the position of the sheet material P1. Further, a control device 9 is connected to the servo motor 6 and the detector PH1 to control the servo motor 6 to momentarily decrease its number of revolutions (R.P.M.) in response to the detection signal from the detector PH1 immediately before the sheet material P1 is completely discharged from the clamp rollers 5. The rotative speed of the clamp rollers 5 is therefore momentarily lowered so that the sheet material P1 is discharged at low speed. Accordingly, the sheet material P1 conveniently falls down onto a table 8 so that sheet materials P1 are regularly stacked on the table 8. No backling takes place in the leading end of the sheet material P1.

6 Claims, 1 Drawing Sheet

SHEET MATERIAL STACKING APPARATUS

This is a continuation of co-pending application Ser. No. 07/185,553, filed on Apr. 25, 1988, now abandoned.

FIELD OF THE INVENTION

This invention relates to a sheet material stacking apparatus for stacking sheet materials which includes plastic bags and the like.

PRIOR ART

For example, in a process for successively producing a number of plastic bags by using a continuous plastic material, a plurality of stacker belts and a plurality of clamp rollers for successively delivering and discharging the plastic bags have been generally used. The produced bag is directed to and clamped between the stacker belts which are driven by a drive motor to deliver the plastic bag to the clamp rollers. The plastic bag is then clamped between the clamp rollers. It is usual that the clamp rollers are operatively connected to the stacker belts so that the clamp rollers are rotated synchroneously with the stacker belts at a peripheral speed corresponding to that of the stacker belts. The plastic bag is therefore smoothly delivered to the clamp rollers and discharged therefrom. The plastic bag is discharged toward and stopped by a stopper plate and falls down onto a table. The succeeding bags likewise fall down onto the table. Accordingly, plastic bags are stacked on the table.

In this apparatus, what is considered as most important is the speed-up of the production and stacking of plastic bags. Accordingly, it is desired to drive the stacker belts and clamp rollers at high speed to deliver and discharge the plastic bags at high speed. However, there have been problems associated with the discharge of plastic bags. When discharged at high speed, the plastic bag collides with the stopper plate and rebounds from the stopper plate. As a result, the plastic bags irregularly fall down and are irregularly stacked on the table. It sometimes also occurs that backling takes place in the leading end of the plastic bag.

SUMMARY OF THE INVENTION

Accordingly, an object of the invention is to provide a novel and improved sheet material stacking apparatus for stacking sheet materials such as plastic bags and the like, which solves the problems inherent in the prior art.

Another object of the invention is to provide a novel and improved sheet material stacking apparatus wherein after a sheet material is delivered from sheet material delivering means and discharged from clamp rollers, the sheet material conveniently falls down onto a table so that sheet materials are regularly stacked on the table with no backling taking place in the leading end of the sheet material.

According to the invention, a servo motor is operatively connected to the clamp rollers to rotate the latter. A detector is disposed upstream of the clamp rollers and detects the position of the sheet material. Further, a control device is connected to the servo motor and the detector to control the servo motor to momentarily decrease its number of revolutions (R.P.M.) in response to the detection signal from the detector immediately before the sheet material is completely discharged from the clamp rollers. The rotative speed of the clamp rollers is therefore momentarily lowered so that the sheet material is discharged at low speed. Accordingly, the sheet material conveniently falls down onto a table so that sheet materials are regularly stacked on the table. No backling takes place in the leading end of the sheet material.

In a developed form of the invention, a second detector is disposed downstream of the clamp rollers and detects the position of the sheet material. The control device is connected to the second detector to control the servo motor for increasing and restoring the number of revolutions (R.P.M.) of the servo motor in response to a detection signal from the second detector after the sheet material has been completely discharged from the clamp rollers.

The first detector may comprise a first photosensor disposed upstream of the clamp rollers and detects the trailing end of the sheet material. The second detector may comprise a second photosensor disposed downstream of the clamp rollers and detects the trailing end of the sheet material.

The sheet material delivering means may comprise a plurality of stacker belts, which are operatively connected and continuously drived by a drive motor, so that a sheet material is clamped between and delivered from the stacker belts.

A tachogenerator may be provided to detect the number of revolutions (R.P.M.) of the drive motor for the stacker belts, the detection signal therefrom which comprises a voltage signal being transmitted to the control device. On the basis of the voltage signal from the tachogenerator, the control device controls the servo motor for the clamp rollers in accordance with the number of revolutions (R.P.M.) of the drive motor for the stacker belts so that the clamp rollers are rotated synchroneously with the stacker belts at a peripheral speed which is equal to or slightly higher than that of the stacker betls.

The control device may be connected to the tachogenerator through a voltage divider which may be connected to the first and second photosensors. The voltage divider has a switching function to momentarily lower a voltage signal transmitted from the tachogenerator to the control device upon receipt of a detection signal from the first photosensor, and to elevate and restore the voltage signal transmitted to the control device upon receipt of a detection signal from the second photosensor.

DESCRIPTION OF THE PREFERRED EMBODIMENTS

Figure 1:
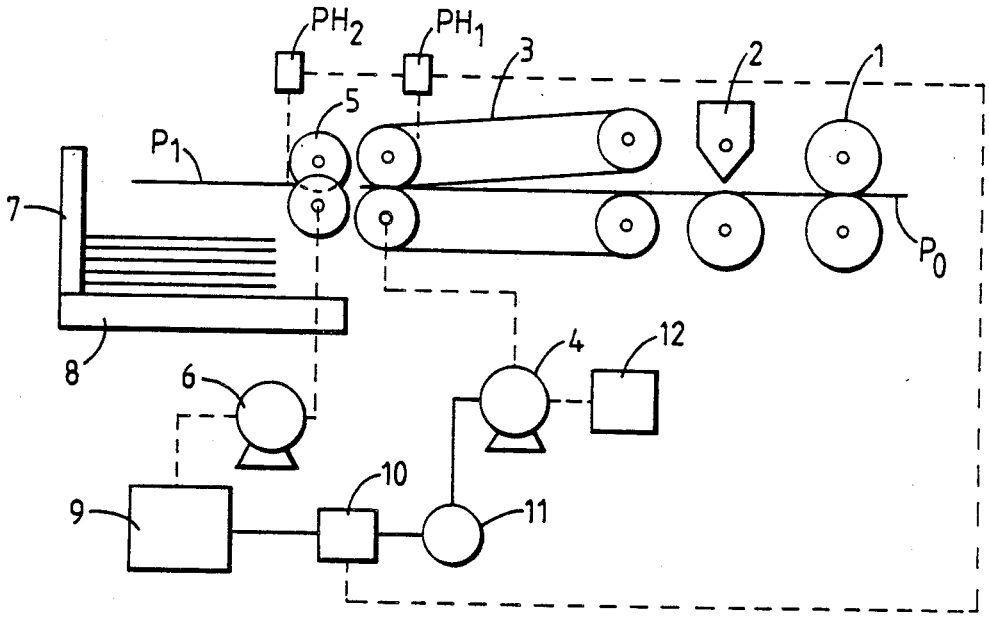
FIG. 1 is a schematic view showing a sheet material stacking apparatus according to the invention.

Referring to FIG. 1, an apparatus for producing and stacking plastic bags Pl according to the invention is shown, which includes a pair of rubber rollers 1 and a heat cut bar 2. The rubber rollers 1 are adapted to feed a continuous plastic material Po to the position of the heat cut bar 2, the plastic material Po being folded in two along its center line and clamped between the rubber rollers 1 and intermittently fed by a given amount each time. The heat cut bar 2 is then lowered toward and pressed against the plastic material Po. The plastic material Po is therefore heat cut in the direction of the width, the heat cut edges thereof being heat sealed, whereby a number of plastic bags Pl are successively produced.

Further, this apparatus has a plurality of stacker belts 3 operatively connected to and continuously drived by a drive motor 4. Each time the seal bar 2 is lowered, the upper stacker belts 3 is lowered at a given distance to clamp the heat cut plastic bag Pl between the stacker belts 3 so that the plastic bag Pl is delivered by the stacker belts 3. Accordingly, a number of plastic bags Pl are successively delivered from the stacker belts 3.

A plurality of clamp rollers 5 are disposed adjacent the terminal ends of the stacker belts 3 so that the plastic bag Pl is delivered to and clamped between the clamp rollers 5. The clamp rollers 5 are operatively connected to and continuously rotated by a servo motor 6 to deliver and discharge the plastic bag Pl. The plastic bag Pl is discharged toward and stopped by a stopper plate 7 and fall down onto a table 8.

Figure 2:
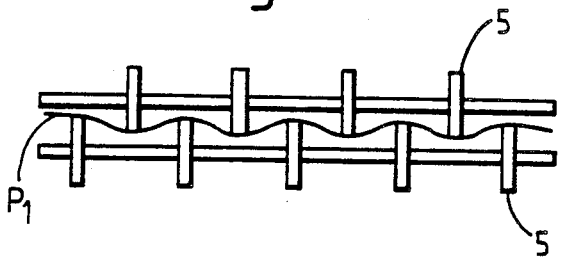
FIG. 2 is a front view showing a plastic bag deformed by clamp rollers shown in FIG. 1.

In the case where the plastic bag Pl is relatively light in weight, it may deflect upward or downward when discharged from the clamp rollers 5 and subjected to air resistance. In this embodiment, the clamp rollers 5 are spaced widthwise of the plastic bag Pl and disposed in upper and lower rows in staggered relation as shown in FIG. 2, so that the plastic bag Pl is deformed in wave form between the clamp rollers 5. This imparts rigidity to the plastic bag Pl to ensure that the plastic bag Pl does not deflect upward or downward and is discharged straightly. Further, in the case where the plastic bag Pl is relatively thick, the degree of deformation of the plastic bag Pl can be reduced by raising the upper clamp rollers 5 and lowering the lower clamp rollers 5. It is also possible to keep the plastic bag Pl flat and then discharge it in the flat state.

This apparatus has a control device 9 for controlling the servo motor 6 for the clamp rollers 5. The control device 9 is connected to the servo motor 6 and a detector which comprises a first photosensor PH1. The photosensor PH1 is adapted to detect the position of the plastic bag Pl and disposed upstream of and adjacent the clamp rollers 5. In this embodiment, the photosensor PH1 detects the trailing end of the plastic bag Pl. Further, the control device 9 is connected to a second detector comprising a second photosensor PH2 which is adapted to detect the position of the plastic bag Pl. The photosensor PH2 is disposed downstream of the clamp rollers 5 and detects the trailing end of the plastic bag Pl. As will be later described, the control device 9 controls the servo motor 6 in response to detection signals from the photosensors PH1 and PH2 so that the number of revolutions (R.P.M ) of the servo motor 6 can be momentarily decreased immediately before the plastic bag Pl is completely discharged from the clamp rollers 5.

Figure 3:
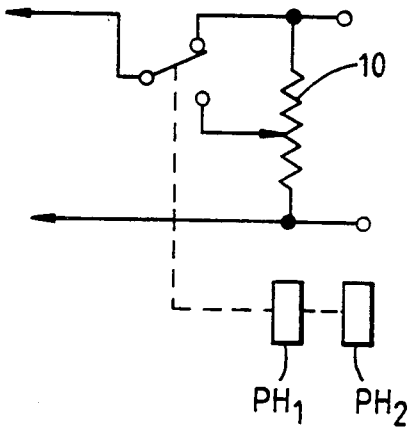
FIG. 3 is an electric circuit diagram of a voltage divider shown in FIG. 2.

In this embodiment, the control device 9 is connected to a tachogenerator 11 through a voltage divider 10 which is connected to the photosensors PH1 and PH2. The tachogenerator 11 is connected to the drive motor 4 for the stacker belts 3 and detects the number of revolutions (R.P.M.) of the drive motor 4 to produce a detection signal which comprises a voltage signal. The voltage signal is transmitted from the tachogenerator 11 to the voltage divider 10 and the control device 9. The voltage divider 10 has a switching function to momentarily lower the voltage signal transmitted from the voltage divider 10 to the control device 9 as shown in FIG. 3. The voltage signal is lowered to a value which can be optionally adjusted by the voltage devider 10.

Further, this apparatus has a control device 12 adapted to increase or decrease the number of revolutions (R.P.M.) of the drive motor 4.

In the apparatus constructed in the matter described above, the drive motor 4 is controlled by the control device 12 to drive the stacker belts 3 at high speed so that the plastic bag Pl is delivered at high speed and clamped between the clamp rollers 5. The tachogenerator 11 produces a voltage signal corresponding to the number of revolutions (R.P.M.) of the drive motor 4, which is transmitted to the voltage divider 10 and the control device 9. The control device 9 normally controls the servo motor 6 in accordance with the number of revolutions (R.P.M.) of the drive motor 4 on the basis of the voltage signal from the tachogenerator 11 so that the clamp rollers 5 are rotated synchroneously with the stacker belts 3 at a peripheral speed which is equal to or slightly higher than that of the stacker belts 3. The plastic bag Pl is therefore smoothly delivered between the stacker belts 3 and the clamp rollers 5, with no slack taking place in the plastic bag Pl. Further, the stacker belts 3 and the clamp rollers 5 are driven at high speed to deliver the plastic bag Pl at high speed.

Further, when the plastic bag Pl passes by the position of the photosensor PH1 immediately before the plastic bag Pl is completely discharged, the photosensor PH1 detects the trailing end of the plastic bag Pl, the detection signal thereof being imparted to the voltage divider 10 The voltage divider 10 thereby performs the switching function to momentarily lower the voltage signal transmitted from the tachogenerator 11 to the control device 9. The control device 9 thereby momentarily decrease the number of revolutions (R.P.M.) of the servo motor 6 to momentarily lower the rotative speed of the clamp rollers 5. Thereafter, when the plastic bag Pl is completely discharged from the clamp rollers 5 and passes by the position of the photosensor PH2, the latter detects the trailing end of the plastic bag Pl, the detection signal therefrom being imparted to the voltage divider 10. The voltage divider 10 thereby performs the switching function to elevate and restore the voltage signal transmitted to the control device 9 to increase and restore the number of revolutions (R.P M.) of the servo motor 8 and elevate and restore the rotative speed of the clamp rollers 5.

Accordingly, the plastic bag Pl is discharged from the clamp rollers 5 at low speed and stopped by the stopper plate 6 without rebounding from the stopper plate 6. The succeeding bags Pl therefore regularly fall down onto the table 7. No backling takes place in the leading end of the plastic bag Pl. In addition, when the rotative speed of the clamp rollers 5 is momentarily lowered immediately before the plastic bag Pl is completely discharged from the clamp rollers, the plastic bag Pl is detected by the clamp rollers 5 against the inertia of the plastic bag Pl so that it is straightened by the inertia and discharged from the clamp rollers 5. The straightened bag Pl is stopped by the stopper plate 6 and falls down onto the table 7. Accordingly, plastic bags Pl are regularly stacked on the table 7.

In addition, the clamp rollers 5 are rotated at high speed for almost all the time except only a moment immediately before the plastic bag Pl is completely discharged. Accordingly, the plastic bag Pl can be derivered and discharged at hight speed by the stacker belts 3 and the clamp rollers 5 to speed-up the production and stacking of plastic bags Pl.

In another embodiment, a rotative amount measuring means may be used to measure the rotative amount of the clamp rollers 5 after detecting the trailing end of the plastic bag Pl and impart a command signal to the control device 9 when the rotative amount reaches a given value so that the control device 9 controls the servo motor 6 to momentarily lower the rotative speed of the clamp rollers 5 in timed relation with the plastic bag Pl discharged. It may be arranged that the photosensor PH1 detects the leading end of the plastic bag Pl instead of its trailing end. In the case where the rotative amount of the clamp rollers 5 is to be measured, it is not always necessary to use the photosensor PH2 It is also possible to elevate and restore the rotative speed of the clamp rollers 5 when the rotative amount thereof reaches a given value after the rotative speed has been lowered. Further, another type of detector, such as a proximity switch, may be used in place of the photosensor PH1 and disposed upstream of the clamp rollers 5. The control device 9 may be separate from the tachogenerator 11 to control the servo motor 6 independently of the drive motor 4. It is not always necessary to use the voltage devider 10.

This apparatus can be arranged to stack other sheet materials than the plastic bags Pl. It may be contemplated to use other sheet material delivering means than the stacker belts 3.

As has been described so far, according to the invention, immediately before a sheet material is completely discharged from clamp rollers, the rotative speed of the clamp rollers is momentarily lowered so that the sheet material conveniently falls down onto a table. Accordingly, sheet materials are regularly stacked on the table No backling takes place in the leading end of the sheet material.

What is claimed is:

1. A sheet material stacking apparatus comprising: heat cut bar means for heating cutting a continuous plastic material, the plastic material being folded in two along its center line, intermittently fed to said heat cut bar means and heat cut by said heat cut bar means to successively produce a number of plastic bags;

upper and lower stacker belt mean disposed downstream of said heat cut bar means and continuously driven, the upper stacker belt means is lowered toward the lower stacker belt means whenever the plastic material is heat cut by said heat cut bar means to clamp the plastic bag between the upper and lower stacker belt means so that the plastic bag is torn from said heat cut bar means by the stacker belt means;

upper and lower clamp rollers disposed downstream of and adjacent the stacker belt means to clamp the plastic bar delivered from said stacker belt means between the clamp rollers, the plastic bag being discharged from said clamp rollers so that its falls down for stacking the plastic bags;

a servo motor operatively connected to said clamp rollers to rotate the same;

a detector disposed upstream of said clamp rollers to detect the position of said plastic bag;

a control device connected to said motor and said detector so that after the plastic bag is completely delivered from said stacker belt means to said clamp rollers and immediately before the plastic bag is completely discharged from said clamp rollers, said control device controls said servo motor to momentarily decrease the number of revolution (R.P.M.) thereof in response to a detection signal from said detector; and said clamp roller being spaced widthwise of the plastic bag and disposed in upper and lower rows in staggered relation for deforming the plastic bag into wave form between said claim rollers so as to shape the plastic bag into more rigid structure for ease of handling and stacking.

2. A sheet material stacking device as set forth in claim 1, further comprising a second detector disposed downstream of said clamp rollers to detect the position of said sheet material, said control device being connected to said second detector, so that after said sheet material has been completely discharged from said clamp rollers, said control device controls said servo motor to increase and restore the number of revolutions (R.P.M.) thereof in response to a detection signal from said second detector.

3. A sheet material stacking device as set forth in claim 2, wherein said detector comprises a first photosensor disposed upstream of said clamp rollers to detect the trailing end of said sheet material, while said second detector comprises a second photosensor disposed downstream of said clamp rollers to detect the trailing end of said sheet material.

4. A sheet material stacking device as set forth in claim 3, wherein said sheet material delivering means comprises a pair of stacker belts, said stacker belts being operatively connected to a drive motor so that it is continuously rotatively driven and the sheet material is clamped between and delivered by said stacker belts.

5. A sheet material stacking device as set forth in claim 4, further comprising a tachogenerator for detecting the number of revolutions (R.P.M.) of the drive motor, the detection signal therefrom comprising a voltage signal and transmitted to said control device, said control device normally controlling said servo motor in accordance with the number of revolutions (R.P.M.) of said drive motor on the basis of the voltage signal from said tachogenerator, so as to rotate said clip rollers at a peripheral speed which is equal to or slightly greater than that of said stacker belts.

6. A sheet material stacking device as set forth in claim 5, wherein said control device is connected to said tachogenerator through a voltage divider, said voltage divider being connected to said first and second photosensors and having a switching function to momentarily lower the voltage signal transmitted from said tachogenerator to said control device upon receipt of a detection signal from said first photosensor and elevate and restore the voltage signal transmitted from said tachogenerator to said control device upon receipt of a detection signal from said second photosensor.

* * * * *